United States Patent [19]

Shimada et al.

[11] Patent Number: 4,643,596

[45] Date of Patent: Feb. 17, 1987

[54] IMPACT TYPE DOT PRINTER

[75] Inventors: Tatsuo Shimada; Yoshinori Chida; Satoru Tada, all of Tokyo, Japan

[73] Assignee: Seikosha Co., Ltd., Tokyo, Japan

[21] Appl. No.: 776,997

[22] Filed: Sep. 17, 1985

Related U.S. Application Data

[60] Continuation of Ser. No. 575,347, Jan. 31, 1984, abandoned, which is a division of Ser. No. 183,922, Sep. 3, 1980, Pat. No. 4,465,386.

[30] Foreign Application Priority Data

Sep. 17, 1979 [JP] Japan ..... 54-119506
Jun. 30, 1980 [JP] Japan ..... 55-88937

[51] Int. Cl.[4] ..... B41J 3/08
[52] U.S. Cl. ..... 400/121; 101/93.04
[58] Field of Search ..... 400/121, 158, 158.1, 400/159, 655; 178/4, 25; 101/93.04, 93.15–93.17

[56] References Cited

U.S. PATENT DOCUMENTS 3,324,240 6/1967 Kleinschmidt et al. ..... 101/93.04 X
3,804,008 4/1974 Hoyer ..... 101/93.04
3,834,304 9/1974 Potter ..... 101/93.04
3,926,293 12/1975 Ljungberg ..... 101/93.16 X
4,024,941 5/1977 Sekikawa ..... 400/124
4,077,336 3/1978 Talvard et al. ..... 101/93.05
4,202,638 5/1980 Stenudd ..... 400/124

*Primary Examiner*—Paul T. Sewell
*Attorney, Agent, or Firm*—Robert E. Burns; Emmanuel J. Lobato; Bruce L. Adams

[57] ABSTRACT

An impact dot printer has a print head which reciprocates back and forth in front of a rotationally driven platen to print dot matrix characters on a recording medium. The print head includes a single print hammer actuated by an electromagnetic driver. A succession of print timing signals are produced in synchronism with the rotational speed of the platen, and a home signal is generated each time the print head leaves its home position during the printing of each line. A control circuit initiates the printing of each line in response to the first print timing signal produced after generation of the home signal and controls the application of driving pulses to the electromagnetic driver so as to synchronize the actuation of the print hammer with the platen rotation.

4 Claims, 6 Drawing Figures

IMPACT TYPE DOT PRINTER

This is a continuation of application Ser. No. 575,347, filed Jan. 31, 1984, abandoned, which, in turn, is a divisional of application Ser. No. 183,922 filed Sept. 3, 1980 and now U.S. Pat. No. 4,465,386.

BACKGROUND OF THE INVENTION

There is a known impact type dot printer as disclosed in U.S. Pat. No. 3,629,504. The known printer comprises a print head mounted on a carriage which is movable along guide shafts relative to a rotary platen. The platen has a plurality of angularly spaced-apart projections or ridges which coact with a print hammer of the print head to print dot-matrix characters on a recording medium situated between the print hammer and the platen. The print hammer confronts one of the projections substantially in a crossing manner and is selectively actuated when it confronts the selected projection of the rotary platen at proper positions corresponding to the respective row positions of a dot-matrix of characters to be printed. In such a printer, it is very difficult to properly control the printing operation since the positions of printed dots are determined by the relative positional relationship between the print hammer and the projections of the platen. Accordingly, the known printer is adapted to progressively print each symbol or character during each printing cycle and, to synchronize the initiation of each printing cycle with the position of the projections of the platen, it requires sensing means for sensing the position of the projections of the platen and means responsive to the sensing means for controlling initiation of each printing cycle and for thereafter controlling the print hammer to print at each predetermined grid block location until each entire symbol has been printed. Further, there is actually required to employ two transducers for controlling the printing operation.

SUMMARY OF THE INVENTION

It is an object of the present invention to provide a cross hammer impact type dot printer capable of controlling the synchronization of the printing operation of a print hammer with the position of projections of a rotary platen by employing a single detector cooperative with a slotted disc and a timer circuit for measuring the pulse distance between pulses produced by the detector.

According to the present invention, there is provided to cross hammer impact type dot printer comprising a rotary platen provided on its outer periphery with a plurality of projections extending parallel to the axis thereof, a print head movable parallel to said platen in front thereof at a speed related to the rotation of the platen, the print head having a single print hammer opposing across a selected one of the projections in confronting relation, and electromagnetic driving means for driving the print hammer to impact an ink ribbon and a recording medium positioned between the platen and the print head against the corresponding projection. A slotted disc is rotatably driven at a rate of rotation which is an integral multiple of that of the platen, the slotted disc having a plurality of groups of slots coaxially aligned therewith and blank portions having no slot between the groups of the slots, the number of the slots in each group corresponding to the number of rows of a dot matrix of a character to be printed, a detector for periodically producing print timing signals in conjunction with the slotted disc, each of the print timing signals being composed of sequential pulses corresponding to the rows of dot matrix and a pulse-free blank, a timer circuit for measuring pulse intervals of the pulses produced by the detector, and a control circuit effective to operate the electromagnetic driving means for the print hammer in synchronism with rotation of the platen in conjunction with the detector and the timer circuit.

The above and other objects, features and advantages of the present invention will become more apparent from the following description when taken in conjunction with the accompanying drawings in which a preferred embodiment of the present invention is shown by way of an illustrative example.

DESCRIPTION OF THE PREFERRED EMBODIMENT

Figure 1:
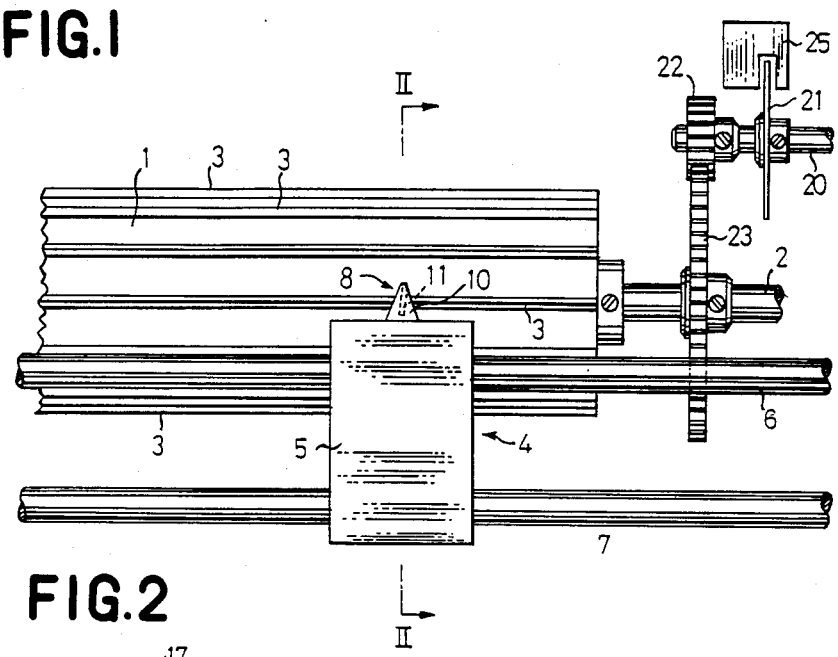
FIG. 1 is a schematic front elevational view of one embodiment of an impact type dot printer according to the present invention.

Reference in the following description to "left", "right", "front", "rear", etc. refer to the directions as shown in the drawings.

A preferred embodiment of an impact type dot printer according to the present invention will be described with reference to FIGS. 1 to 6.

Figure 2:
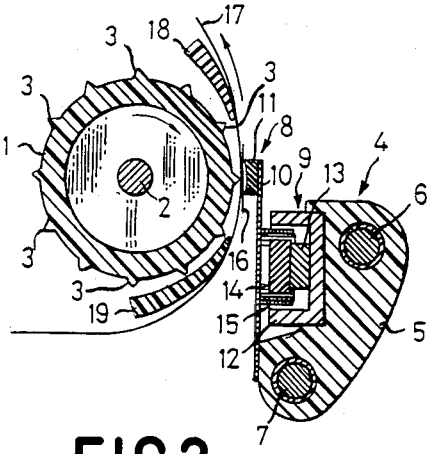
FIG. 2 is a sectional view taken along the line II—II of FIG. 1.

Referring first to FIGS. 1 and 2, a drum-shaped rotary platen 1 is fixed to a platen shaft 2 and is rotated substantially continuously in the clockwise direction as viewed in FIG 2. The platen 1 has a length substantially corresponding to the lateral width of a recording paper 17. A plurality (12 are shown in the illustrated embodiment) of linear projections 3, each projection extending substantially parallel to the axis of the platen, are formed on the outer periphery of the platen. A print head 4 is disposed opposite to the platen 1 so as to move in the axial direction of the platen, i.e., in the direction perpendicular to the direction of feed of the recording paper 17, at a position ahead of the platen 1.

A carriage 5 carrying the print head 4 is made of a light-weight non-magnetic material and is slidably supported by guide shafts 6, 7. A print hammer 8 for forming dots on the recording paper 17 in cooperation with the projections 3 on the platen, upon collision with the projections when driven by electromagnetic driving means 9, is provided at a rear side of the carriage 5.

The print hammer 8 and the electromagnetic driving means 9 have the following construction. The print hammer 8 comprises a leaf spring 10 secured at its lower end to the carriage 5, and a striking member 11 fixed to the upper end of the leaf spring 10. The striking member 11 extends substantially in the same direction as the direction of feed of the recording paper 17 so as to be oppositely adjacent to one of the projections 3 positioned ahead of the striking member, and has a length which is only slightly greater than the height of the letters or characters to be printed.

The electromagnetic driving means 9 includes an outer magnetic yoke 12 in the form of a cylinder open at one end, a relatively strong permanent magnet 13 made of, for example, samarium cobalt and fixed to the bottom of the magnetic yoke 12, an inner magnetic yoke 14 fixed to the permanent magnet 13 and a moving coil 15 fixed to the leaf spring 10 and disposed in the magnetic gap between the magnetic yokes 12, 14. An ink ribbon 16 is disposed between the striking member 11 of the print hammer 8 and the platen 1. The recording paper 17 is fed in the direction shown by an arrow shown in FIG. 2 through the gap between the ink ribbon 16 and the platen 1, while being guided by paper guides 18, 19.

Figure 3:
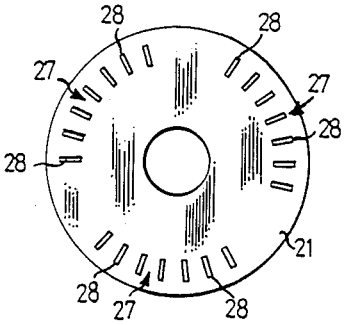
FIG. 3 is an enlarged front elevational view of a slotted disc of the printer of FIG. 1 for row detection.

A rotary shaft 20 is rotated by a motor (not shown). The rotary shaft 20 carries a slotted disc 21 and a pinion 22. The pinion 22 meshes with a gear 23 fixed to the platen shaft 2. A detector 25 has a light-emitting element and a light-receiving element which are arranged opposite to one another at the periphery of the slotted disc 21. As shown in FIG. 3, the slotted disc 21 is provided adjacent its periphery with a plurality of groups 27 (three are shown in the illustrated embodiment) of slots, each group consisting of a plurality of slots 28 arranged at a constant pitch. The number of slots 28 in each group 27 corresponds to the number of rows M of a character of a M-row, N-column dot matrix. In the illustrated embodiment, the number of slits 28 in each group 27 is 7. Further, the slotted disc 21 is provide between groups 27 of the slots 28 with blank or slot-free portions having no slot, the blank portions having an angular extent corresponding to that of three slots. As shown in FIG. 3, the slotted regions and the slot-free regions are alternately and symmetrically disposed around the disc 21. The arrangement is such that the platen 1 makes a 30° rotation while the slotted disc 21 makes a 120° rotation. Namely, in this embodiment, the reduction ratio between the pinion 22 and the gears 23 is selected to be $\frac{1}{4}$. The detector 25 periodically produces print timing signals b as shown in FIG. 5B, each of which is constituted by a pulse component having 7 equi-spaced sequential pulses $Pb_1$, $Pb_2$–$Pb_7$ followed by a pulse-free component per one cycle. The row positions of the dots are determined by respective pulses $Pb_1$, $Pb_2$–$Pb_7$ which are generated when selected ones of the projections 3 of the platen 1 are rotated to positions corresponding to the first, second–seventh rows.

Figure 6:
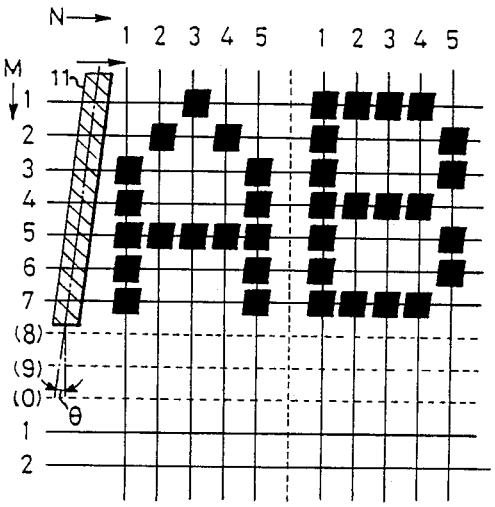
FIG. 6 is an enlarged view showing letters formed by the printer of FIG. 1.

The print head 4 is adapted to be moved along the guide shafts 6, 7 by means of a shift drive device (not shown). The speed of movement of the print head 4 during the printing operation, i.e. the speed when the print head 4 is moved from a home position (not shown) to the right, is related to the rotational speed of the platen 1. As shown in FIG. 6, the striking member 11 of the print hammer 8 has a length at least corresponding to the height of the characters to be printed, and is inclined at an angle $\theta$ to the direction of feed of the recording paper. The angle $\theta$ of inclination of the striking member 11 is dependent upon the shift speed of the print head 4. In the illustrated embodiment, this angle $\theta$ is about 7° to 8°. The reason why the striking member 11 is inclined will be fully understood from the following description.

Figure 4:
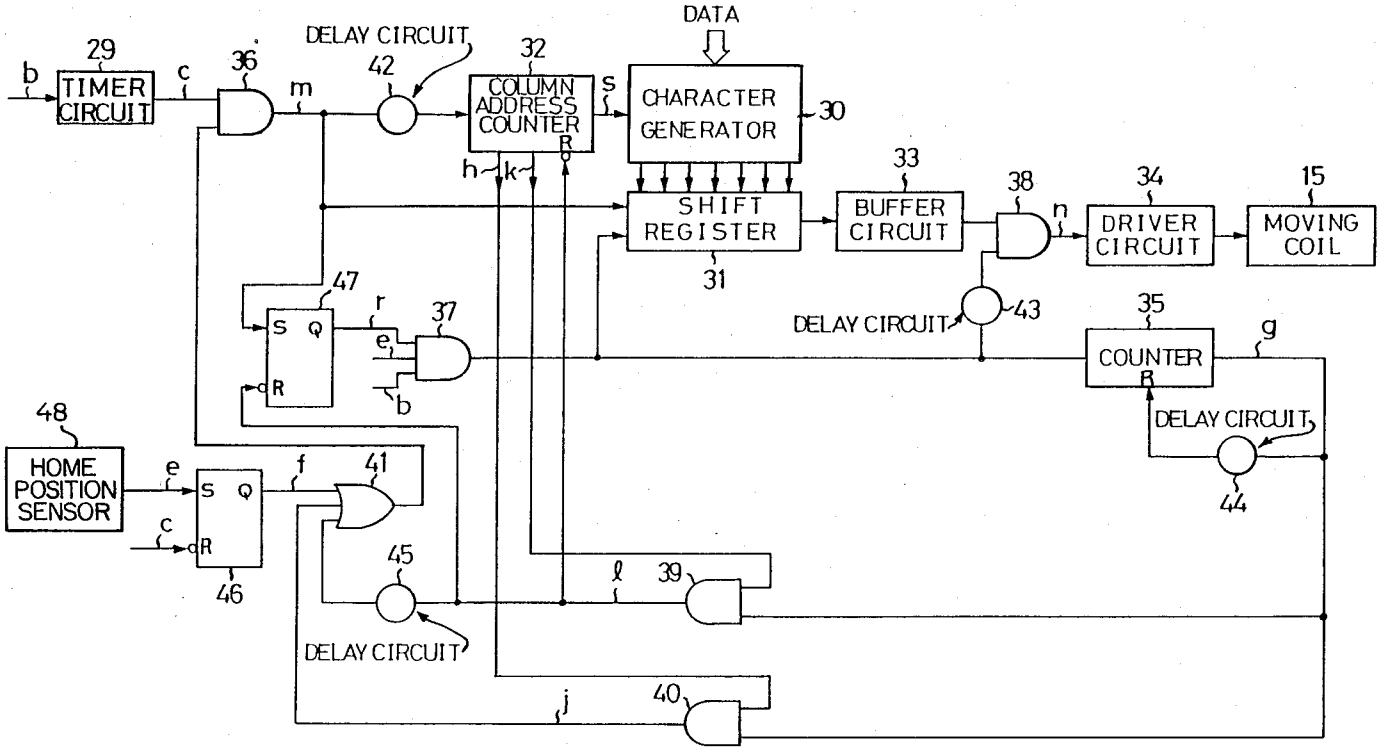
FIG. 4 is a circuit diagram of a driving control circuit of the printer of FIG. 1.

The moving coil 15 shown in FIG. 2 is connected to a driving control circuit shown in FIG. 4. This driving control circuit includes a timer circuit 29, a character generator 30, a shift register 31, a column address counter 32, a buffer circuit 33, a driver circuit 34, a counter 35, AND gates 36 to 40, an OR gate 41, delay circuits 42 to 45, and flip-flop circuits 46, 47. The column address counter 32 is adapted to produce an output signal S corresponding to a counted number, and the column of the character generator 30 is determined by this output signal S. The column address counter 32 also produces output signals h, k.

The output signals h, k take the logical values of "1" and "0" until the number N of the column of the dot matrix, i.e. 5, is counted. As the number of columns is counted, the logical values of these signals are inverted to "0" and "1" respectively. The logical value of the counter 35 is inverted from "0" to "1" as the number of rows M of the dot matrix, i.e. 7, is counted and is reset to "0" after a time delay which is determined by means of the delay circuit 44.

The timer circuit 29 effects the measurement of pulse intervals between the pulses $Pb_1$, $Pb_2$–$Pb_7$ of print timing signal b and produces output pulses $Pc_1$, $Pc_2$—as shown in FIG. 5C when long pulse intervals are detected. The output pulses from the timer circuit 29 are produced between the pulses $Pb_7$ and $Pb_1$ and are utilized as the column detect or column-end signals and signify the end of the printing of the successive columns of the dot matrix characteristics. The flip-flop circuit 46 is set by the rise of a printing start position detect signal or home signal e which is generated by a home position sensor 48 when the print head 4 leaves the home position, and is reset by the fall of the signal c. The flip-flop circuit 47 is set and reset by the rise of a signal m from the AND gate 36 and by the fall of the signal l from the AND gate 39.

The operation of the printer of FIGS. 1 to 7 will now be described.

The print head 4 is initially located at the left-hand side of the platen 1. The printing operation is performed in the following manner as the print head 4 is moved from the home position at the left-hand side of the platen 1 to the right. First of all the platen driving motor is energized by a start signal a shown in FIG. 5A, so that the drive shaft 20 is rotated and the platen shaft 2 is rotated through the pinion 22 and the gear 23, so that the platen 1 is rotated continuously in the clockwise direction as viewed in FIG. 2, at a predetermined speed. As a result, the detector 25 starts to produce the signals b and the timer circuit 29 measures the pulse intervals of the signals b.

Then, as a print head shift command signal d is generated as shown in FIG. 5D, a print head 4 starts to shift from the home position toward the right. As the print head 4 runs a predetermined distance from the home position, the printing start position detect signal or home signal e is produced as shown in FIG. 5E by a sensor (not shown). In consequence, the flip-flop circuit 46 shown in FIG. 4 is set by the printing start postion detect signal e, so that an output signal f from the flip-flop circuit 46 is inverted to logical value "1" as shown in FIG. 5F. This output signal f is supplied to one of the input terminals of the AND gate 36 through the OR gate 41, and thus the AND gate 36 is opened.

Figure 5:
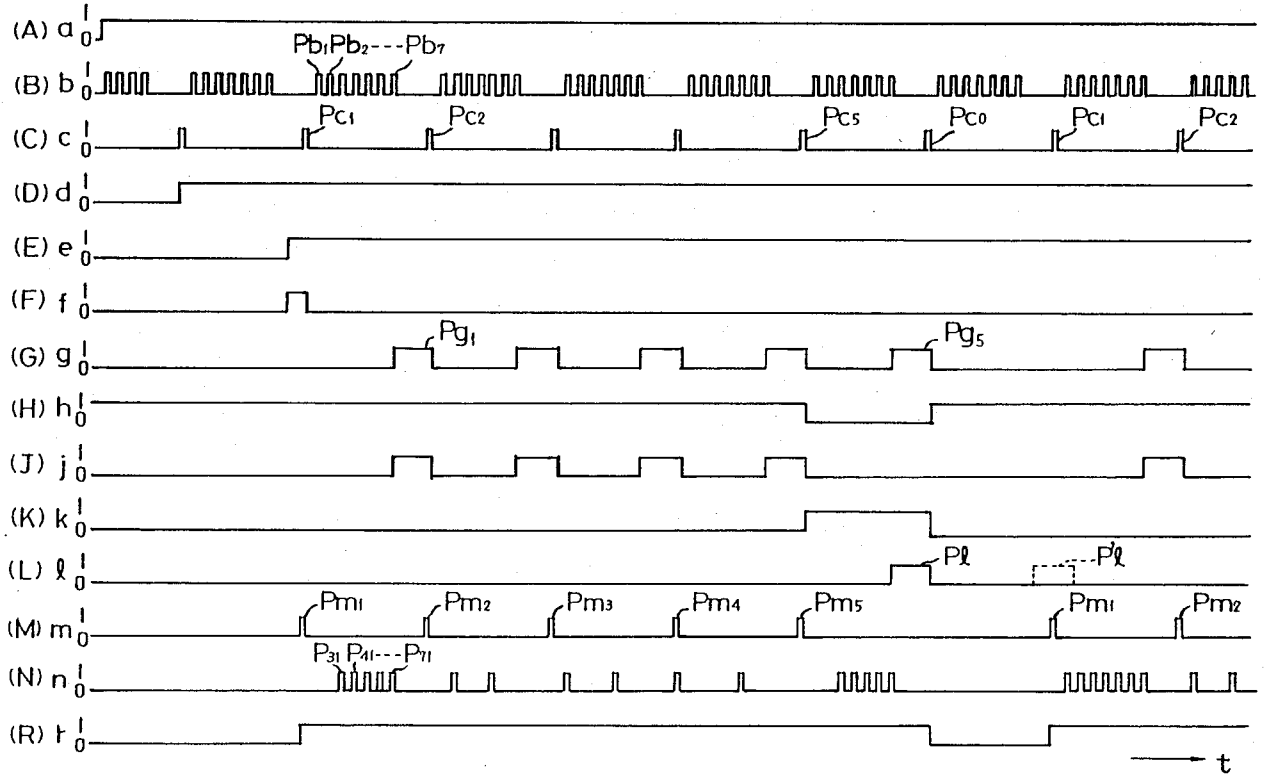
FIG. 5 is a timing chart illustrating the operation of the driving control circuit of FIG. 5.

Characters such as letters, numerals, symbols and the like corresponding to data transferred, for example, from a computer have already been memorized in the character generator 30 in the form of a dot matrix pattern. The character generator 30 is adapted to produce pattern signals of the column of the appointed address corresponding to the column address signal s, in accordance with the latter. Since in this state the value counted by the column address counter 32 is zero, the character generator 30 is producing the pattern signal of the first column of the dot matrix pattern of the character corresponding to the transferred data, and the output signals h, k from the column address counter 32 take the logical values of "1" and "0" respectively, as shown in FIGS. 5H and 5K. In this state, the pulse $Pc_1$ of the signal c is produced by the timer circuit 29 and is supplied to the AND gate 36 so that the AND gate 36 produces an output with a logical value of "1". At the same time, the flip-flop circuit 46 is reset by the fall of the pulse $Pc_1$ from the timer circuit 29 so that the output signal f from the flip-flop 46 takes a logical value of "0". In consequence, the AND gate 36 produces a pulse $Pm_1$ which appoints the first column of the dot matrix pattern, as shown in FIG. 5. As a result, the pattern signal of the first column of the data transmitted to the character generator 30 in FIG. 4 is written in and memorized by the shift register 31, and the flip-flop circuit 47 is set by the rise of the pulse $Pm_1$ to make the flip-flop circuit 47 produce an output signal r having a logical value of "1". Then, the detector 25 shown in FIG. 1 produces pulses $Pb_1$, $Pb_2$–$Pb_7$ of the signal b as shown in FIG. 5B. The pulses $Pb_1$, $Pb_2$–$Pb_7$ are supplied to the AND gate 37. Since the logical values of the other two input terminals of the AND gate 37 have logical values of "1", the pulses $Pb_1$, $Pb_2$–$Pb_7$ are allowed to pass through the AND gate 37. Then, the pattern signal which has been written in the shift register 31 is read out from the latter in accordance with the formation order, i.e. the order of roqs, by the pulses $Pb_1$, $Pb_2$–$Pb_7$, and is delivered to one of the input terminals of the AND gate 38. Simultaneously with the reading out operation referred to above, the pulses $Pb_1$, $Pb_2$–$Pb_7$ are delivered to the other input terminal of the AND gate 38 through the delay circuit 43. Therefore, the AND gate 38 produces as an output signal n driving pulses corresponding to the pattern signals of the first column, with a slight phase lag relative to the generation of the pulses $Pb_1$, $Pb_2$–$Pb_7$. For instance, assuming here that the data transmitted to the character generator 30 corresponds to a letter A, the AND gate 38 produces driving pulses $P_{31}$, $P_{41}$–$P_{71}$ as shown in FIG. 5N. These driving pulses are so formed that they are produced when any one of the projections 3 of the platen 1 rotating continuously in the direction of the arrow shown in FIG. 2 is positioned at positions of the third row, the fourth row—the seventh row ahead of the striking member 11 of the print hammer 8 as viewed in FIG. 6. The striking member 11 which is inclined at the angle $\theta$ is continuously moving in the direction of the arrow as viewed in FIG. 6 by the shift operation of the print head 4. Therefore, when the driving pulses $P_{31}$, $P_{41}$–$P_{71}$ are produced, the projection 3 and the striking member 11 successively cross each other on the third, fourth–seventh rows of the first column. Referring to FIG. 4, as the AND gate 38 produces the driving pulses $P_{31}$, $P_{41}$–$P_{71}$, the driver circuit 34 is activated by the driving pulses $P_{31}$, $P_{41}$–$P_{71}$ so that driving current pulses are supplied to the moving coil 15. The moving coil 15 produces a magnetic flux which coacts with the magnetic flux in the gap between the magnetic yoke 14 which is magnetized by the permanent magnet 13, and as a consequence, the moving coil 15 is displaced to the left. The print hammer 8 is thus also displaced to the left overcoming the force of the leaf spring 10, and the striking member 11 instantaneously collides with the projection 3 of the rotating platen 1, so that the dot of the first column of the letter A is formed on the recording paper 17 at the position where the projection 3 and the striking member 11 cross and collide with each, as shown FIG. 6.

The description of the printing operation is suspened here, and an explanation will be made as to why the striking member 11 of the print hammer 8 is inclined. As has already been described, the striking member 11 of the print hammer 8 operates while it is being moved to the right on the recording paper as viewed in FIG. 6. Assuming first that the striking member 11 crosses the projection 3 at right angles, the position of crossing of the projection 3 and the striking member 11 is shifted gradually downwards in accordance with the rotation of the projection 3 and, at the same time, deviated slightly to the right in accordance with the rightward movement of the striking member 11. In consequence, the dots in the column or vertical direction are arrayed obliquely and the letter formed on the paper is inclined. Therefore to avoid this problem, the striking member 11 is inclined at an angle of about 7° to 8°, so that the dots in the column direction are arrayed along a straight line in the direction of feed of the recording paper. This angle, however, can be modified slightly depending upon the design of the letters to be formed. For instance, if the letters are to be formed obliquely, the angle $\theta$ may be selected to be much greater.

The description of the printing operation will now be resumed. Referring to FIG. 4, when the aforementioned writing in of data in the shift register 31 by the pulse $Pm_1$ of the AND gate 36 is completed, the pulse $Pm_1$ is counted by the column address counter 32 through the delay circuit 42. The content of the column address counter 32 is increased by unity so that the character generator 30 produces the pattern signal for the second column. The output pulses from the AND gate 37, i.e. the pulses $Pb_1$, $Pb_2$–$Pb_7$ are counted by the counter 35 and, as the counted number reaches 7, i.e. as the dot-forming operation is finished, an output signal g from the counter 35 takes a logical value of "1" as shown in FIG. 5G. At this time, the output signal h of the column address counter 32, which is the input signal to one input terminal of the AND gate 40, is held at a logical value of "1" so that an output signal j from the AND gate 40 takes a logical value of "1" and is supplied to the AND gate 36 via the OR gate 41. The AND gate 36 produces, as shown in FIG. 5M, a pulse $Pm_2$ which appoints the second column of the dot matrix, and the counter 35 is reset through the delay circuit 44. Then, the dots of the second column are formed in the same manner as described above in relation to the first column. Namely, the formation of the dots of the second column is performed by the cooperation between the striking member 11 and the projection 3 next to the projection used in the formation of the dots of the first column. This operation is repeated to form dots of the third, fourth and fifth columns, thereby completing the formation of the letter in a 7×5 dot matrix as shown in FIG. 6.

Referring again to FIG. 4, as the column address counter 32 counts up to 5, the logical signals h, k therefrom are inverted to take logical values "0" and "1" respectively. In consequence, the pulse $Pg_5$ produced from the counter 35 after the printing operation for the fifth column makes the AND gate 39 produce an output pulse Pl as shown in FIG. 5L. The column address counter 32 and the flip-flop circuit 47 are reset by the fall of this output pulse Pl. In consequence, the output signals h, k from the column address counter 32 resume logical values "1", "0", so that the output signal r from the flip-flop 47 takes the logical value of "0". Also, the pulse Pl is delayed by the delay circuit 45 to become a pulse Pl' as shown by a broken line. This delay pulse Pl' is supplied to the AND gate 36 through the OR gate 41. Therefore, if the AND gate 36 receives a pulse $Pc_0$ after completion of printing of a letter, the AND gate 36 does not produce any pulse as will be seen from FIG. 5M, but produces the output pulses $Pm_1$ when the next column detect pulse $Pc_1$ is received. Namely, the next character is printed after formation of a space corresponding to one dot column, as will be seen from FIG. 6.

According to the present invention as described above, it is possible to easily and properly control and synchronize actuation of a print hammer with positions of a selected projection of a rotary platen by employing a single detector cooperative with a slotted disc having a plurality of groups of slots coaxially aligned therewith and a timer circuit effective to measure pulse intervals between output pulses from the detector.

What is claimed is:

1. An impact type dot printer for printing row-by-column dot matrix characters on a recording medium, comprising: a rotationally driven platen having on its outer periphery a plurality of circumferentially spaced ridges extending parallel to the axis of rotation of the platen; a movable print head movable from a home position in a direction parallel to the axis of rotation of the platen at a speed proportional to the speed of rotation of the platen, the print head comprising a single print hammer extending crosswise of the platen ridges and operable when actuated to impact an ink ribbon and recording medium positioned between the print head and one of the platen ridges to thereby print a dot of a dot matrix character on the recording medium, and electromagnetic driving means responsive to driving pulses for actuating the print hammer; a slotted disc rotationally driven at a speed of rotation proportional to the speed of rotation of the platen, the disc having therearound a plurality of angularly extending slotted regions separated by angularly extending slot-free regions, each slotted region having a plurality of angularly equi-spaced slots equal in number to the number of rows of the row-by-column dot matrix and each slot-free region being free of any slots, the slotted regions and the slot-free regions being alternately and symmetrically disposed around the disc; detecting means coacting with the disc for periodically producing print timing signals in accordance with the rotation of the disc, each print timing signal having a pulse component composed of a series of equi-spaced pulses corresponding in number to the number of slots in one slotted region followed by a pulse-free component corresponding to one slot-free region; timing means for measuring the pulse interval between the pulses of the print timing signals and producing column-end signals signifying the end of each dot matrix column in response to measurement of long pulse intervals corresponding to the pulse-free components of the print timing signals; means for generating a home signal when the print head leaves the home position during each line of printing; and control circuit means responsive to the home signal, the print timing signals and the column-end signals for initiating each line of printing in response to the detection of the first pulse-free component produced after generation of the home signal and for controlling the application of driving pulses to the electromagnetic driving means to thereby synchronize the actuation of the print hammer with the rotation of the platen.

2. An impact type dot printer according to claim 1; wherein the disc has three slotted regions and three slot-free regions.

3. An impact type dot printer according to claim 2; wherein the slots in the disc are disposed in their entirety radially inwardly of the outer periphery of the disc.

4. An impact type dot printer according to claim 1; wherein the slots in the disc are disposed in their entirety radially inwardly of the outer periphery of the disc.

* * * * *